US006991540B2

(12) United States Patent
Marlow

(10) Patent No.: US 6,991,540 B2
(45) Date of Patent: Jan. 31, 2006

(54) PLAYING CARD SUPPLY METHOD AND APPARATUS

(76) Inventor: John Keith Marlow, 7 Palmetto Ct., Broadbeach Waters, Gold Coast QLD AU (AU)

( * ) Notice: Subject to any disclaimer, the term of this patent is extended or adjusted under 35 U.S.C. 154(b) by 103 days.

(21) Appl. No.: 10/477,203

(22) PCT Filed: May 17, 2002

(86) PCT No.: PCT/AU02/00596

§ 371 (c)(1),
(2), (4) Date: Nov. 18, 2003

(87) PCT Pub. No.: WO02/094397

PCT Pub. Date: Nov. 28, 2002

(65) Prior Publication Data

US 2004/0195772 A1 Oct. 7, 2004

(30) Foreign Application Priority Data

May 18, 2001 (AU) ..... PR 5105

(51) Int. Cl.
*A63F 1/12* (2006.01)
*A63F 1/14* (2006.01)

(52) U.S. Cl. ..... 463/16; 463/22; 463/47; 273/149 R; 273/148 R; 273/293; 273/240

(58) Field of Classification Search ..... 273/240, 273/293, 295, 149 R, 148 R, 309; 463/16, 463/22, 47

See application file for complete search history.

(56) References Cited

U.S. PATENT DOCUMENTS

| | | | | | |
|---|---|---|---|---|---|
| 3,327,406 | A | * | 6/1967 | Baker | 434/327 |
| 4,497,488 | A | | 2/1985 | Plevyak | |
| 4,911,452 | A | * | 3/1990 | Marchese, Jr. | 273/240 |
| 5,199,710 | A | * | 4/1993 | Lamle | 463/22 |
| 5,449,179 | A | * | 9/1995 | Hefferan | 273/269 |
| 5,722,893 | A | | 3/1998 | Hill | |
| 6,145,838 | A | * | 11/2000 | White | 273/295 |

FOREIGN PATENT DOCUMENTS

GB 2162073 1/1986

* cited by examiner

*Primary Examiner*—Benjamin H. Layno
(74) *Attorney, Agent, or Firm*—Shoemaker and Mattare

(57) ABSTRACT

A method for supplying playing cards (12) in which indicia carried by the cards (12) is derived or selected randomly and applied to the cards (12) prior to dealing. The indicia carried by the cards (12) is removed after the game is played thereby allowing the cards (12) to be reused and have further randomly derived indicia to be applied. The apparatus (10) for use in the method includes a card delivery chute (26), an indicia removing device (25), a card storage device (11) in which cards (12) are stacked, and an image applying device for applying indicia to the cards (12) for delivery to a card feeding device (24) for playing a game. The method and apparatus may be applied to other game playing pieces and the cards and pieces may be in many different configurations and include an electronic display for displaying indicia.

38 Claims, 2 Drawing Sheets

PLAYING CARD SUPPLY METHOD AND APPARATUS

TECHNICAL FIELD

This invention relates to a method and apparatus for supplying playing or gaming cards or playing pieces as used for example for playing card or other games in gambling establishments but not limited to that use. The present invention also relates to playing or gaming cards or pieces for playing card or other games.

BACKGROUND ART

Casinos and other gambling establishments use conventional playing cards for playing a number of card games for example blackjack and poker. Usually a number of decks of playing cards are provided at each gaming table with the cards being either shuffled by hand or by machine prior to being dealt to the players. One problem encountered in this conventional arrangement is that the effectiveness of the shuffle depends upon the skill of the dealer or the efficiency of the card shuffling machine to ensure that cards dealt are arranged randomly and this is often impossible or very difficult to achieve. Further as a finite number of cards are used in the decks that are shuffled, a problem of card counting can arise in that skilled individuals can count the cards being dealt to relatively accurately predict the next card to be dealt. Particular cards can also be susceptible to being marked which leads to potential cheating. A further disadvantage of the known arrangements is that a large number of decks of cards are used and decks of cards are required to be regularly replaced which leads to a substantial cost to the gambling establishment.

Gaming cards carrying pre-printed material such as bingo cards are also used for playing gambling games in gambling or other establishments. Such cards usually have a one-off use and thus are required to be discarded after use. Other games use playing pieces or other tokens which carry an identifying marking with the pieces or tokens being dealt to a player and the player gambling in accordance with the piece or token received and/or expected to be received. Such games encounter the same disadvantages outlined above in relation to playing card games.

SUMMARY OF THE INVENTION

The present invention aims in one aspect to provide a method and apparatus for supplying playing or gaming cards or pieces for playing a card game or other game such that the respective cards or pieces supplied carry randomly derived or selected indicia. The present invention aims in a further aspect to provide a method and apparatus for supplying playing or gaming cards or pieces carrying removable indicia thereon. The present invention in yet a further aspect aims to provide a method and apparatus for supplying and reusing playing or gaming cards or pieces. The present invention in yet a further aspect aims to provide playing or gaming cards or pieces for playing card or other games. Other objects and advantages of the invention will become apparent from the following description.

The present invention thus provides in a first aspect, a method of supplying playing or gaming cards or pieces for playing a card game or other game, said method including the steps of providing a plurality of carrier members, applying indicia to each said carrier member such that each said carrier member defines a said playing or gaming card or piece with said applied indicia defining the identity of said playing or gaming card or piece, each said indicia for application to said carrier members being derived or selected randomly, supplying said carrier members for use as playing or gaming cards or pieces in a game, and removing said applied indicia from said carrier members to enable said carrier members to be reused.

The playing or gaming cards or pieces defined by the carrier members may comprise physical playing or gaming cards or pieces as well as visual representations of playing or gaming cards or pieces as displayed for example on a monitor or other display device. The term "indicia" as used throughout the specification includes known indicia as used on playing or gaming cards or pieces including in the case of playing cards, the suit of a card, and value information including court card information as well as electronic representations thereof. Thus the card indicia may range from say an ace of clubs to a king of spades and include all suits and all values of conventional playing cards. In the case of gaming cards, the indicia may comprise numbers or other markings, symbols or characters as well as electronic representations thereof and similarly in the case of playing or gaming pieces.

In a further aspect, the present invention provides apparatus for supplying playing or gaming cards or pieces for playing a card game or other game, said apparatus including storage means for storing a plurality of carrier members, means for randomly generating or selecting indicia for application to each said carrier members, means for applying said indicia to each said carrier member whereby each said carrier members defines a said playing or gaming card or piece, said applied indicia defining the identity of a said playing or gaming card or piece, means for supplying said carrier members carrying said indicia for playing a card game or other game, and means for removing said applied indicia from said carrier members to enable said carrier members to be reused.

The present invention in yet a further aspect provides a method of supplying playing or gaming cards or pieces for playing a card game or other game, said method including the steps of providing a plurality of carrier members, applying indicia to each said carrier member whereby each said carrier member defines a playing or gaming card or piece and such that said indicia are displayed temporarily by said carrier members, each said indicia applied to each said carrier member being derived or selected randomly and defining the identity of a said playing or gaming card or piece, and supplying said carrier members for use as playing or gaming cards or pieces in a card game or other game.

In yet a further aspect, the present invention provides apparatus for supplying playing or gaming cards or pieces for playing a card game or other game, said apparatus including means for storing a plurality of carrier members, means for randomly generating or deriving indicia defining the identity of a playing or gaming card or piece, means for applying said indicia to each said carrier member whereby each said carrier member defines a playing or gaming card or piece and such that said indicia are displayed temporarily by said carrier members, and means for supplying said carrier members for use in playing a card game or other game.

The present invention in yet a further aspect provides a method for reusing playing or gaming cards or pieces, said method including the steps of providing a supply of a plurality of carrier members adapted to carry indicia defining the identity of a playing or gaming card or piece, randomly deriving or selecting indicia to be carried by respective said carrier members and causing respective carrier members to display respective said randomly derived or selected indicia whereby each said carrier member defines a playing or gaming card or piece, and removing said displayed indicia from said carrier members whereby said carrier members may be reused.

In yet a further aspect, the present invention provides Apparatus for supplying and reusing playing or gaming cards or pieces, said apparatus including means for storing a plurality of carrier members adapted to carry indicia defining the identity of a playing or gaming card or piece, and means for applying to said carrier members, randomly derived or selected said indicia whereby each said carrier member forms a said playing or gaming card or piece and means for removing said applied indicia from said carrier members.

In yet a further aspect, the present invention provides carrier members for use as playing or gaming cards or pieces for playing card or other games, said carrier members being adapted to carry indicia whereby each said carrier members defines a said playing or gaming card or piece, said indicia carried by each said carrier member defining the identity of a playing or gaming card or piece, said indicia being displayed temporarily by said carrier members such that said carrier members are capable of carrying respective different indicia whereby said carrier members may define different playing or gaming cards or pieces.

The carrier members may themselves comprise playing or gaming cards, playing pieces or other like members which carry the indicia for physically playing a game. Alternatively, the indicia carried by the respective carrier members are used to identify respective playing or gaming cards or pieces corresponding to the indicia carried by the carrier members.

Thus the carrier members in one aspect may comprise blank cards formed of cardboard, plastics or other material of the size and configuration of conventional playing cards or gaming cards. Alternatively, the carrier members may comprise playing pieces having an area or region which can carry identifying indicia. Where the carrier members are of this form, the means for applying the indicia to the respective carrier members or by which the carrier members are treated to carry the indicia may comprise means for printing or otherwise applying, the indicia onto the carrier members using an ink, dye or other marking medium to create an image of the indicia which is removable from the carrier members to enable the carrier members to be reused. In the above arrangement, the card indicia may be removed by means which clean or wipe the ink, dye or other marking medium from the carrier members to enable the carrier members to be reused. Alternatively, the image may be removed by chemical means, light or other physical means.

In an alternative arrangement, the indicia may be provided on stickers or other removable members and the means for applying the indicia to the respective carrier members comprise means for physically applying the removable stickers or members carrying the indicia to the carrier members. The means for removing the indicia in this aspect may comprise means for physically removing the stickers or other members carrying the indicia.

In yet an alternative arrangement, the carrier members may be treated with a light sensitive material which for example may be applied as a coating to or on the carrier members and the indicia may be displayed by subjecting the light sensitive material to light of a particular pattern or having certain characteristics which enable the indicia to be displayed on the light sensitive material. Thus the light sensitive material may comprise a photochromatic ink or coating such that the indicia can be displayed when exposed to a light pattern corresponding to an indicia. Alternatively, the light sensitive material may respond to a particular light polarization to display particular card indicia. In yet an alternative arrangement, the light sensitive material may be sensitive to light of a particular frequency or frequencies.

The image formed by the exposure of the light sensitive material to light may only appear for a certain period of time such that when re-exposed to a different light pattern, a new image showing a new indicia is apparent on the carrier members. Alternatively, the image may be removed by exposing the light sensitive material to light of an alternative frequency, polarization or the like.

In a further form, the light sensitive material may be replaced by a magnetically sensitive material which when subject to a magnetic field of a particular pattern will display indicia corresponding to that pattern. Re-exposure of the magnetically sensitive material to a magnetic field of a different pattern corresponding to different indicia will in effect "remove" the first card indicia and display the different card indicia. The carrier members carrying the magnetically sensitive material may thus be reused.

In another form, the material applied to the carrier members may comprise a thermo chromatic material such that a particular indicia or image to be carried by the carrier members may be displayed when the material is subject to heat from heat applying means which applies heat of a pattern corresponding to the particular indicia or image to be displayed. The indicia or image may fade after a period of time or alternatively may be effectively removed when subject to heat of a different pattern.

In another form, the carrier members carry an optically responsive imprintable material and wherein the apparatus includes means for applying an imprinting signal to the carrier members to display the indicia to be carried by the carrier members.

In a further form, the carrier members may be adapted to carry other physically applied images representing playing card indicia. Such images may be applied by chemical means or by a light source and may be removed by a reverse process to provide the carrier members for reuse.

The carrier members in a further form may comprise or incorporate electronic circuitry which includes a re-programmable memory and a display device such as a liquid crystal display or LED display. The indicia for display by the carrier members may be programmed by external programming means into the memories of respective carrier members for display and use of the carrier members as cards in playing a card game or gaming cards or pieces in other games. The indicia for display are suitably derived randomly as above. Carrier members of this type may then be reused by simply reprogramming the memories with further randomly derived card indicia.

In yet a further form, the indicia carried by the carrier members may be read from a reader to be displayed on a monitor or other display means as playing cards, gaming card or other playing pieces. In this configuration, the carrier members may be in the form of electronic chips, cards or other members which carry electronic or magnetic storage means which may store the indicia or a representation of the indicia. The indicia or an electronic representation of the indicia may be stored in, or programmed into the storage means of the carrier members by any suitable external application means which may comprise an electronic or magnetic transducer. The indicia or representation thereof for storage in the storage means is suitably derived or selected randomly.

The stored indicia or representations thereof stored on the carrier members may be read or determined by any suitable reading means which can read the indicia and display the indicia on suitable display means such as a monitor or other visual display unit. For reuse, the storage means of the carrier members may either have the indicia stored therein removed in a separate device or alternatively, the storage means may be simply reprogrammed such that storage of new indicia information will replace the previously stored indicia information.

The indicia may be randomly derived from any number of pre-stored indicia. In the case of playing cards, the card indicia may be randomly derived or selected from one or more card decks. The method and apparatus allows for the use of carrier members or playing cards for any card game using any number of card decks. Any number of card decks may selected from which the card indicia may be randomly selected. Selection of the number of card decks may be undertaken by means of an electronic controller on the apparatus which may be programmed or switchable to select the number of decks to be used.

The randomly derived or selected indicia applied or applicable to each card or playing piece may if desired be recorded and displayed on a display device on the apparatus or on another form of display for example a video wall to enable other persons to ascertain the cards or pieces being dealt. Thus for example, the dealers cards can be monitored. This information can also be transmitted electronically and interfaced to other computer or storage devices for future reference for example to allow players or gaming authorities to check the value or indicia of particular cards or pieces which have been dealt over a period of time. Furthermore, the randomly derived or selected indicia can be transmitted to locations remote from the point of selection to enable players to play a game.

What is claimed is:

1. A method of supplying playing or gaming cards or pieces to players for playing a card game, said method including the steps of providing a plurality of carrier members, said carrier members initially carrying no indicia applying indicia to each said carrier member whereby each said carrier member defines a playing or gaming card or piece and such that said indicia are displayed temporarily by said carrier members for playing a said game, each said indicia applied to each said carrier member being derived or selected randomly and defining the identity of a said playing or gaming card or piece, and supplying said carrier members carrying said indicia to said players for use as playing or gaming cards or pieces in a card game, and removing said applied indicia from said carrier members to enable said carrier members to be reused.

2. Apparatus for supplying playing or gaming cards or pieces to players for playing a card game, said apparatus including means for storing a plurality of carrier members, said carrier members initially carrying no indicia means for randomly generating or deriving indicia defining the identity of a playing or gaming card or piece, means for applying said indicia to respective said carrier members whereby each said carrier member defines a playing or gaming card or piece whose identity is defined by said applied indicia, said indicia being displayed temporarily by said carrier members for playing a said game, means for supplying said carrier members carrying said applied indicia for use in playing a card game, and means for removing said applied indicia from said carrier members to enable said carrier members to be reused.

3. Apparatus according to claim 2 wherein said playing or gaming cards or pieces comprise physical playing or gaming cards or pieces.

4. Apparatus according to claim 2 wherein said playing or gaming cards or pieces comprise visual representations of playing or gaming cards or pieces as displayed on a monitor or other display device.

5. Apparatus according to claim 2 wherein said means for applying the indicia to the respective carrier members comprises means for printing the indicia on said carrier members to create an image of the indicia.

6. Apparatus according to claim 5 wherein said means for removing said indicia comprises means for cleaning or wiping said image from a said carrier members.

7. Apparatus according to claim 5 wherein said means for removing said indicia comprises chemical means or a light source.

8. Apparatus according to claim 2 wherein said means for removing the indicia comprise electronic removal means.

9. Apparatus according to claim 2 wherein said carrier members carry a light sensitive material and wherein said means for applying said indicia to said carrier members comprise means for subjecting the light sensitive material to a light source to cause said indicia to be displayed by said carrier members.

10. Apparatus according to claim 9 wherein said light sensitive material comprises a photochromatic coating and wherein said means for applying said indicia comprises means for exposing said light sensitive material to a light pattern corresponding to said indicia.

11. Apparatus according to claim 10 wherein said image only appears for a certain period of time such that when re-exposed to a different light pattern, a new image showing a new indicia corresponding to said different light pattern is displayed on the carrier members.

12. Apparatus according to claim 9 wherein said light sensitive material responds to a particular light polarization to display particular card indicia.

13. Apparatus according to claim 9 wherein said light sensitive material is sensitive to light of a particular frequency or frequencies.

14. Apparatus according to claim 9 wherein said means for removing said indicia comprises means for exposing the light sensitive material to light.

15. Apparatus according to claim 2 wherein said carrier members carry a magnetically sensitive material and wherein said means for applying said indicia comprise means for subjecting said magnetically sensitive material to a magnetic field of a particular pattern to cause the display of indicia corresponding to that pattern on said carrier members.

16. Apparatus according to claim 15 wherein said means for applying said indicia comprises means for re-exposing said magnetically sensitive material to a magnetic field of a different pattern corresponding to different indicia to cause the display of said different indicia on said carrier member.

17. Apparatus according to claim 2 wherein said carrier members carry a thermo chromatic material and wherein said means for applying said indicia comprises means for subjecting said carrier members to heat of a pattern corresponding to indicia to be displayed by a said carrier member.

18. Apparatus according to claim 17 wherein said indicia fades after a period of time or may be removed by subjecting said material to heat of a different pattern.

19. Apparatus according to claim 2 wherein said carrier members carry an optically responsive imprintable material and wherein said means for applying said indicia comprise means for applying an imprinting signal to said carrier members to cause the display said indicia by said carrier members.

20. Apparatus according to claim 2 wherein said carrier members comprise electronic circuits including a re-programmable memory and a display device for displaying said indicia.

21. Apparatus according to claim 20 wherein said means for applying said indicia comprise means for externally programming said memory for displaying indicia on said display device.

22. Apparatus according to claim 2 and including means for reading and displaying on display means indicia carried by said carrier members.

23. Apparatus according to claim 2 wherein said carrier members carry electronic or magnetic storage means for storing said indicia or a representation of said indicia, and wherein said means for applying said indicia includes means for externally programming said storage means for storing said indicia or a representation of said indicia.

24. Apparatus according to claim 23 wherein said means for removing said indicia comprise means for removing said stored indicia or representation thereof or reprogramming said storage means with new indicia or representations thereof.

25. Apparatus according to claim 2 wherein said indicia applied to said carrier members comprise card indicia whereby said carrier members define playing cards and wherein said apparatus includes means for selecting the number of decks of cards from which said card indicia may be randomly derived or selected.

26. Apparatus according to claim 2 and including means for electronically transmitting said randomly derived or selected indicia to a remote location.

27. A method for reusing playing or gaming cards or pieces, said method including the steps of providing a supply of a plurality of carrier members adapted to carry indicia defining the identity of a playing or gaming card or piece, said carrier members initially carrying no indicia randomly deriving or selecting indicia to be carried by respective said carrier members, causing respective carrier members to display respective said randomly derived or selected indicia whereby each said carrier member defines a playing or gaming card or piece for use by players playing a game, and removing said displayed indicia from said carrier members whereby said carrier members may be reused.

28. Apparatus for supplying playing or gaming cards or pieces to players for playing a card game, said apparatus including means for storing a plurality of carrier members adapted to carry indicia defining the identity of a playing or gaming card or piece, said carrier members initially carrying no indicia means for applying to said carrier members, randomly derived or selected said indicia whereby each said carrier member carrying said indicia comprises a said playing or gaming card or piece, means for supplying carrier members carrying said applied indicia to said players for playing said card game, and means for removing said applied indicia from said carrier members after playing said game.

29. Carrier members for use as playing or gaming cards or pieces for playing card, said carrier members initially carrying no indicia but being adapted to carry indicia whereby each said carrier member defines a said playing or gaming card or piece, said indicia carried by each said carrier member being derived or generated randomly and defining the identity of a playing or gaming card or piece, said indicia being displayed temporarily by said carrier members whereby said carrier members carrying said indicia can be supplied and used as playing or gaming cards said indicia carried by said carrier members being removable such that said carrier members are capable of carrying respective different indicia whereby said carrier members may define different playing or gaming cards or pieces.

30. Carrier members according to claim 29 and defining physical said playing or gaming cards or playing pieces.

31. Carrier members according to claim 30 wherein said carrier members comprise blank cards of the size and configuration of conventional playing cards or gaming cards.

32. Carrier members according to claim 30 in the form of playing pieces having an area or region which can carry said identifying indicia.

33. Carrier members according to claim 32, further including display means for displaying said indicia.

34. Carrier members according to claim 33, further including reprogrammable memory means for storing indicia information for display by said display means.

35. Apparatus for supplying playing or gaming cards or pieces for playing a card game, said apparatus including means for providing a plurality of carrier members, said carrier members initially carrying no indicia means for randomly generating or selecting to be displayed by said carrier members, means for causing respective said carrier members to display said randomly generated or selected indicia whereby said carrier members define said playing or gaming cards or pieces, means for supplying said carrier members carrying said indicia for playing a card game, and means for removing or deleting said indicia from said carrier members, wherein said carrier members maybe reused.

36. Apparatus as claimed in claim 35 wherein said carrier members include a writable medium for displaying said indicia and wherein said means for causing said carrier members to display said indicia comprises means for programming said writable medium.

37. Apparatus as claimed in claim 35 wherein said playing or gaming cards or pieces comprise visual representations of playing or gaming cards or pieces as displayed on a display device.

38. Apparatus for supplying playing or gaming cards or pieces to players for playing a card game, said apparatus including a storage device for storing a plurality of carrier members, said carrier members initially carrying no indicia a random indicia generator or selector for randomly generating or deriving indicia defining the identity of a playing or gaming card or piece, an indicia applying device for applying said indicia to respective said carrier members whereby each said carrier member defines a playing or gaming card or piece whose identity is defined by said applied indicia, said indicia being displayed temporarily by said carrier members for playing a said game, and a supplying device for supplying said carrier members carrying said applied indicia for use in playing a card game, and a card indicia removal device for removing said indicia from said carrier members.

* * * * *

UNITED STATES PATENT AND TRADEMARK OFFICE

CERTIFICATE OF CORRECTION

PATENT NO. : 6,991,540 B2
APPLICATION NO. : 10/477203
DATED : January 31, 2006
INVENTOR(S) : Marlow It is certified that error appears in the above-identified patent and that said Letters Patent is hereby corrected as shown below:

In column 5, line 39 "players to play a game." should read
-- players to play a game from anywhere in the world. A system may also be set up to enable persons to bet on someone else's dealt hand. This of course may apply to any number of persons who can remotely view the hand being dealt and bet accordingly irrespective of the actions of the persons at the local site where the cards or carrier members are dealt. Thus a particular player say in game of blackjack may after having been dealt the first two cards which are viewable by other persons at the remote site to decide not to bet on a third card. Players at the remote location however may also decide not to bet on a third card or alternatively bet on the third card and possibly a fourth and fifth card depending upon whether cards at the local site may be dealt to other players. Thus any number of players may participate in the one game. This system of course can also apply to other forms of game using playing cards, gaming cards or playing or gaining pieces.

BRIEF DESCRIPTION OF THE DRAWINGS

In order that the invention may be more readily understood and put into practical effect, reference will now be made to the accompanying drawings which illustrate preferred embodiments of the invention. The embodiments describe relate in particular to card games however it will be appreciated that the same principles may be applied for use in other games such as gambling games using cards or other gaming pieces. In the drawings.

DETAILED DESCRIPTION OF THE PREFERRED EMBODIMENTS

Figure 1:
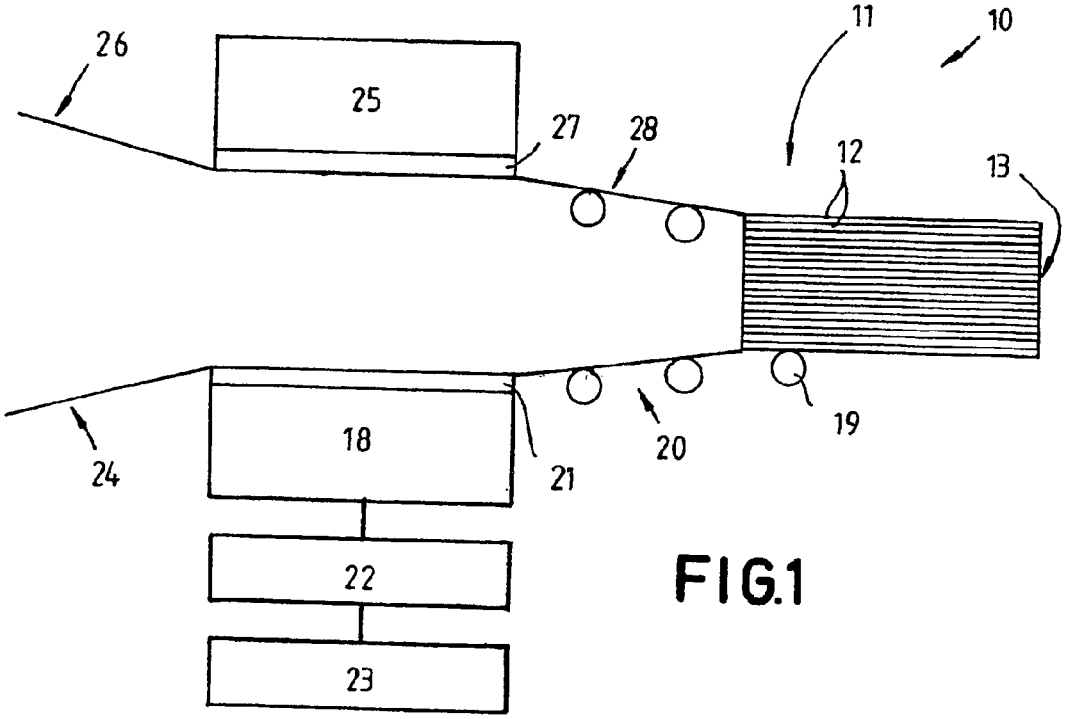
Fig. 1 illustrates schematically a first form of playing card supplying and reusing apparatus according to an embodiment of the invention.
Figure 2:
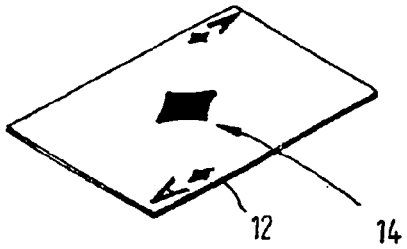
Fig. 2 illustrates a first form of carrier member carrying card indicia.

Referring to the drawings and firstly to Fig. 1, there is illustrated schematically a first form of playing card supplying and reusing apparatus 10 according to the present invention. The apparatus 10 includes card storage means 11 which is arranged to store a plurality of cards 12 in a stack 13. The stack 13 of cards 12 may be arranged vertically as illustrated, horizontally or in any other orientation. The cards 12 in this embodiment and as shown in Fig. 2 are adapted to carrying conventional playing card indicia 14 in the case illustrated the ace of diamonds and may comprise simple blank cards formed of plastics, paper or cardboard of the size and configuration of conventional playing cards It is certified that error appears in the above-identified patent and that said Letters Patent is hereby corrected as shown below:

upon which playing card indicia 14 may be removably printed or otherwise marked or may comprise "cards" formed of or carrying any other material which may carrying playing card indicia. For example, the cards 12 may be impregnated with a chemical which when subject to light or heat will display playing card indicia or any other indicia corresponding to the pattern of light or heat applied to the cards 12.

Figure 3:
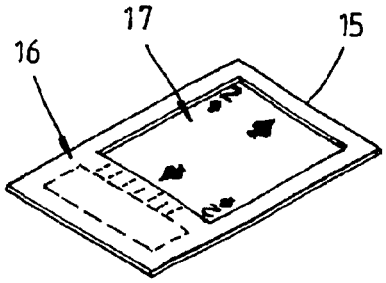
Fig. 3 illustrates a second form of carrier member carrying card indicia.

In another form and as shown in Fig. 3, the cards 12 may be a thin member 15 again of a similar size and configuration to of conventional playing cards and encapsulating data storage means in the form of a programmable memory 16 and a display device 17 which may comprise a liquid crystal display means, LED display means or any other electrical or electronic display means. The programmable memory 16 may be programmed by suitable external electronic means such as a transducer to store indicia information and cause the display device 17 to display card indicia in this case the card value two of spaces. Alternatively, the display device 16 may be such as to respond itself to light or light waves of a certain frequency to display a particular card indicia.

The apparatus 10 further includes a card indicia applying device 18 for applying card indicia onto individual cards 12 supplied from the stack 13 which for example may be delivered one by one from the lower end of the stack 13 by a suitable individual card displacement device such as a driven roller 19 or pusher onto conveying means 20 for conveyance to the card indicia applying device 18. In a simplified form, the conveying means 20 may comprise a chute to direct cards under the influence of gravity into the indicia applying device 18 whilst in an alternative configuration, the conveying means 20 may comprise rollers including opposed cooperating rollers and/or a conveyor belt or belts.

The card indicia applying device 18 in one embodiment may be a printing device having a printing head 21 for printing card indicia onto respective cards 12 however as referred to above the card indicia applying device 18 may apply stickers carrying card indicia onto the carrier members 12 or alternatively, the device may be electrical or electronic programming means for programming card indicia into a particular card 12 or light or magnetic field applying means to cause a card indicia or image to be displayed on the card 12.

Associated with the indicia applying device 18 is a control unit 22 which controls operation of the indicia applying device 18. Associated with the control unit 22 is a random card indicia generator or selector 23 which determines the card indicia to be applied by the applying device 18 to respective cards 12. The random card indicia generator or selector 23 can randomly select or generate a signal representing a particular card indicia selected for example from a card deck of an infinite number of cards so as to ensure complete randomness of selected card indicia. Alternatively, the random card indicia generator or selector 23 may be set to randomly select card indicia It is certified that error appears in the above-identified patent and that said Letters Patent is hereby corrected as shown below:

from one or more standard card decks depending upon the requirements of the game or the establishment conducting the game. Upon the random indicia generator or selector 23 randomly selecting the indicia to be applied to a particular card, the control unit 22 causes the indicia applying device 18 to apply the randomly selected indicia to the card 12 fed to the device 18. Cards 12 carrying the applied indicia are then fed individually from the indicia applying device 18 by suitable feeding means 24 such as a chute, feed rollers and/or feed belts for playing a game. If desired the apparatus 10 may be incorporated into a gaming table so that cards 12 may be delivered directly for playing a game on the table for example for delivering cards for playing the game of blackjack.

The apparatus 10 also includes a card indicia removal device 25 for removing the indicia applied to the cards 12. Card delivery means 26 in the form of a chute (and/or rollers or belts) are provided to deliver cards 12 to the device 25. The card indicia removal device 25 may comprises apparatus for cleaning, wiping or otherwise removal of the card indicia by physical means and for this purpose may include a wiping head 27 which may be motor driven to wipe the indicia from the cards 12. The wiping head 27 for example may comprise a rotatable brush. Alternatively, the card indicia removal device 25 may comprise chemical cleaning means, or light, heat or magnetic field applying means. Alternatively the device 25 may comprise a device for re-programming of a card 12 where the card 12 is an electronic device of the type described with reference to Fig. 3. In some situations, it may not be necessary to use a separate card indicia removal device 25 as for example reprogramming of a Fig. 3 type card 12 to display different card indicia may occur within the card indicia applying device 18.

Where a card indicia removal device 25 is employed, cards 12 after removal of the indicia are fed back to the card storage means 11 to be placed in the stack 13 with other cards 12 by for example, rollers 28 and/or with chutes and/or conveyor belts. The cards 12 with indicia removed and stored in the storage means 11 may then be reprinted or reprogrammed for reuse in the manner described above.

Figure 4:
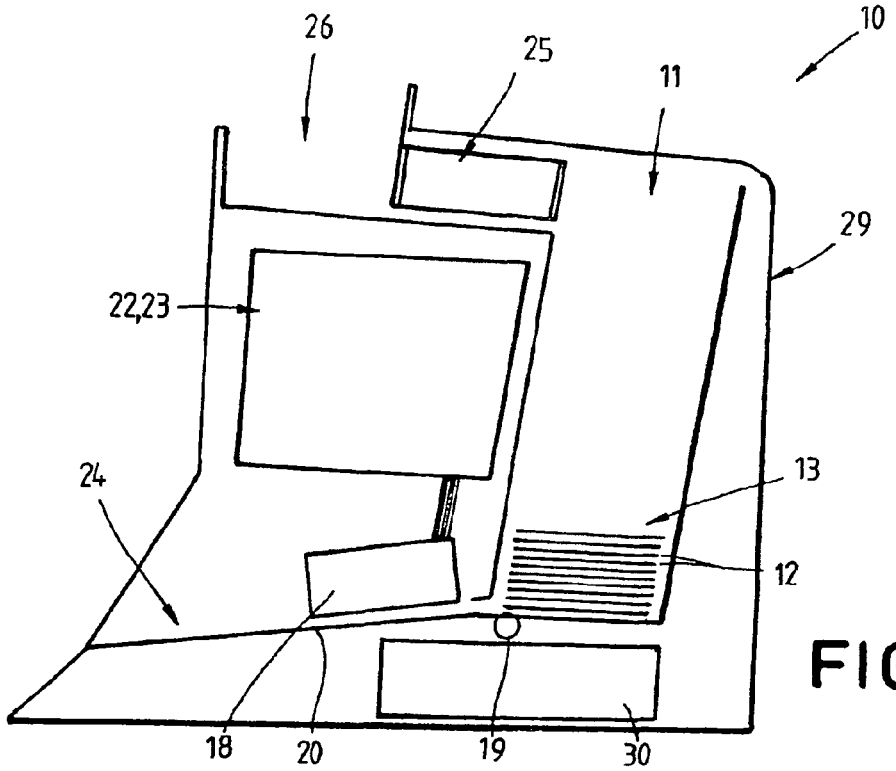
Fig. 4 illustrates schematically in sectional view, a further form of the apparatus of Fig. 1.

Fig. 4 illustrates the layout of a practical embodiment of the apparatus 10 in which like components to those of Fig. 1 have been given like numerals. All the components of the apparatus 10 are provided in a common housing 29 which includes a card deposit chute 26 at its upper end which receives cards 12 and directs cards past the card indicia removal device 25. After passing the device 25, the cards 12 with indicia removed are deposited in card storage means 11 to form a stack 13 ready to be reprogrammed or reprinted. Individual cards 12 from the lower end of the stack 13 are displaced consecutively by displacement roller 19 onto chute 20 to pass through the card programmer or imager 18 by which the indicia as selected by the random indicia generator or selector 23 and under control of the control unit 22 is placed on cards 12.

It is certified that error appears in the above-identified patent and that said Letters Patent is hereby corrected as shown below:

As referred to above, the cards 12 may be playing cards, chips or other writable medium compatible with the programming or imaging device 18 and indicia remove device 25. The programmed or printed cards 12 are then by are fed out through the chute 24 for use in playing a game. Typically, the control unit 22 may include a programmable microprocessor which may also incorporate the random indicia generator or selector 23. The housing 29 also houses a power supply 30 for the electrical components of the apparatus 10. Cards 12 carrying the randomly generator or selected indicia may be delivered to a shoe to be dealt by the dealer in the game. Alternatively, the dealer may by depression of a switch, cause cards 12 in the stack 13 to be delivered to the programming or imaging device 18 for supply to players in the game on demand.

Figure 5:
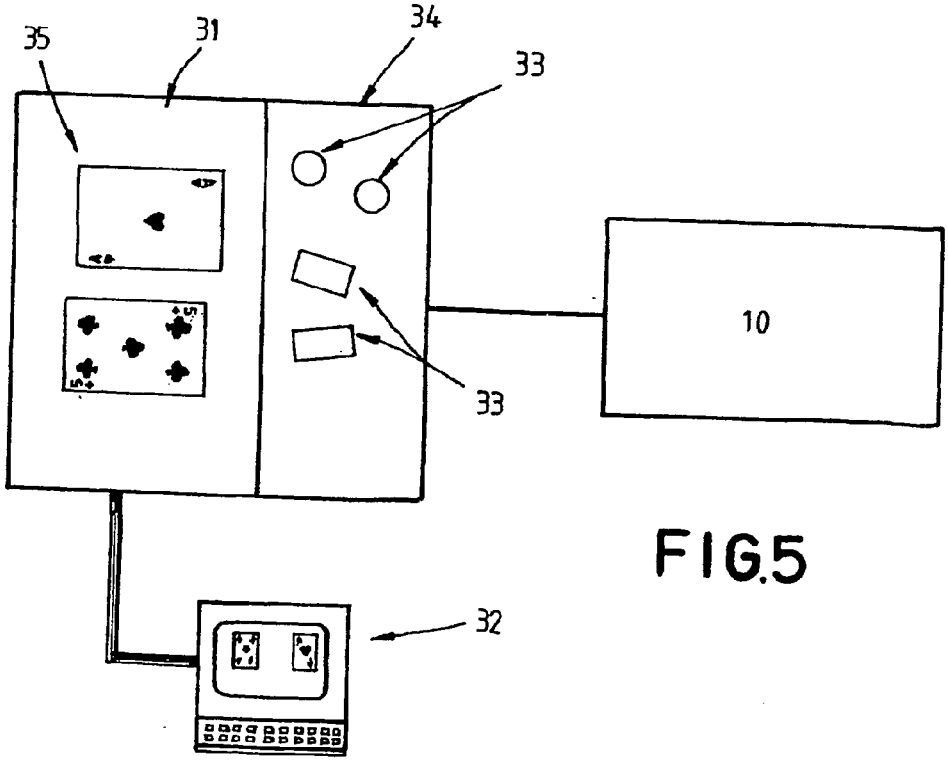
Fig. 5 illustrates schematically a second form of playing card supplying and reusing apparatus according to a further embodiment of the invention.

Referring now to Fig. 5, there is illustrated an alternative embodiment of the invention which incorporates the principles of the invention as described with reference to the embodiment of Fig. 1 but which is adapted to display playing cards carrying particular card indicia through a monitor or other display device 31. It will be appreciated that this information may be transmitted to a remote site for remote viewing for example on monitor 32 or for remote playing of a game. In this embodiment, the playing card delivery apparatus 10 is arranged to supply cards, electronic chips or other readable devices 33 which carry randomly generated card indicia. The cards, chips or other readable devices 33 may include magnetic or electronic storage means such that the card indicia may be magnetically or electronically stored therein. The card indicia is derived randomly in the same manner as previously described and may be applied to the devices 33 by any suitable magnetic or electronic programming means which will store the random card indicia in respective devices 33. To enable a playing card or play card indicia represented or carried by a device 33 to be displayed, an image or signal detection pad 34 is provided upon which the readable devices 33 may be placed. The card indicia carried by the devices 33 may then be detected and read through the monitor or other display device 31 and displayed as at 35 and/or displayed at the remote monitor 32.

At the cessation of the game, the readable devices 33 are delivered back to the apparatus 10 where the indicia carried thereby are removed either by separate electronic or magnetic removal means or during or by reprogramming with new card indicia.

The playing cards or pieces or images of the indicia carried thereby may be used for playing any card game. The cards however may be in the form of other gaming cards such as bingo cards wherein the numbers carried are randomly generated and applied and removed as above. The playing cards may also comprise playing pieces for playing any other form of game where random selection is required, the playing pieces carrying or being capable of carrying indicia or other information identifying the playing piece.

UNITED STATES PATENT AND TRADEMARK OFFICE

CERTIFICATE OF CORRECTION

PATENT NO. : 6,991,540 B2
APPLICATION NO. : 10/477203
DATED : January 31, 2006
INVENTOR(S) : Marlow It is certified that error appears in the above-identified patent and that said Letters Patent is hereby corrected as shown below:

Whilst the above has been given by way of illustrative embodiment of the invention, all such modifications and variations thereto as would be apparent to persons skilled in the art are deemed to fall within the broad scope and ambit of the invention as defined in the appended claims. --

Signed and Sealed this

Fifteenth Day of July, 2008

JON W. DUDAS
*Director of the United States Patent and Trademark Office*